US007651460B2

(12) United States Patent
Gan

(10) Patent No.: US 7,651,460 B2
(45) Date of Patent: Jan. 26, 2010

(54) TOTALLY IMPLANTABLE HEARING SYSTEM

(75) Inventor: Rong Z. Gan, Oklahoma City, OK (US)

(73) Assignee: The Board of Regents of the University of Oklahoma, Norman, OK (US)

( * ) Notice: Subject to any disclaimer, the term of this patent is extended or adjusted under 35 U.S.C. 154(b) by 882 days.

(21) Appl. No.: 11/084,561

(22) Filed: Mar. 18, 2005

(65) Prior Publication Data

US 2005/0261544 A1 Nov. 24, 2005

Related U.S. Application Data

(60) Provisional application No. 60/555,201, filed on Mar. 22, 2004.

(51) Int. Cl.
*H04R 25/00* (2006.01)

(52) U.S. Cl. ..... 600/25; 381/312

(58) Field of Classification Search ..... 600/25; 607/55–57; 623/10; 381/322, 326, 328, 381/330, 380, 382

See application file for complete search history.

(56) References Cited

U.S. PATENT DOCUMENTS 3,870,832 A * 3/1975 Fredrickson ..... 600/25
4,352,960 A 10/1982 Dormer et al.
4,606,329 A 8/1986 Hough
4,612,915 A 9/1986 Hough et al.
4,774,933 A 10/1988 Hough et al.
4,776,322 A 10/1988 Hough et al.
RE32,947 E 6/1989 Dormer et al.
4,957,478 A 9/1990 Maniglia
5,015,224 A * 5/1991 Maniglia ..... 600/25
5,015,225 A 5/1991 Hough et al.
5,259,032 A 11/1993 Perkins et al.
5,360,388 A 11/1994 Spindel et al.
5,411,467 A 5/1995 Hortmann et al.
5,430,803 A * 7/1995 Kimura et al. ..... 381/380
5,498,226 A 3/1996 Lenkauskas
5,554,096 A 9/1996 Ball
5,558,618 A * 9/1996 Maniglia ..... 600/25
5,624,376 A 4/1997 Ball et al.
5,800,336 A 9/1998 Ball et al.

(Continued)

FOREIGN PATENT DOCUMENTS

WO PCT/US05/09269 8/2005

OTHER PUBLICATIONS

IMPLEX Brochure, "Tica® LZ 3001—The Invisible Hearing System," 22 pages, available at least one year prior to Mar. 2003.

*Primary Examiner*—Charles A Marmor, II
*Assistant Examiner*—Carrie Harris
(74) *Attorney, Agent, or Firm*—Dunlap Codding, P.C.

(57) ABSTRACT

A totally implantable hearing system having a sound processing device, a coil assembly, and a magnet assembly. The magnet assembly is implanted in the middle ear of a user and is in contact with at least a portion of an ossicle of the middle ear. The sound processing device receives and converts sound into an electrical signal. The coil assembly is preferably implanted within the bony canal wall adjacent the outer ear canal of the user such that at least a portion of the coil assembly extends into the middle ear space of the user.

42 Claims, 4 Drawing Sheets

U.S. PATENT DOCUMENTS 5,814,095 A 9/1998 Müller et al.
5,857,958 A 1/1999 Ball et al.
5,859,916 A 1/1999 Ball et al.
5,888,187 A 3/1999 Jaeger et al.
5,913,815 A 6/1999 Ball et al.
5,999,632 A 12/1999 Leysieffer et al.
6,084,975 A 7/2000 Perkins
6,093,144 A 7/2000 Jaeger et al.
6,094,493 A 7/2000 Borowsky et al.
6,139,488 A * 10/2000 Ball ..... 600/25
6,161,046 A 12/2000 Maniglia et al.
6,190,305 B1 2/2001 Ball et al.
6,198,971 B1 3/2001 Leysieffer
6,227,204 B1 5/2001 Baumann et al.
6,251,062 B1 6/2001 Leysieffer
6,277,148 B1 8/2001 Dormer
6,334,072 B1 12/2001 Leysieffer
6,422,991 B1 7/2002 Jaeger
6,436,028 B1 8/2002 Dormer
6,475,134 B1 11/2002 Ball et al.
6,517,476 B1 2/2003 Bedoya et al.
6,537,200 B2 3/2003 Leysieffer et al.
6,537,201 B1 3/2003 Kasic, II et al.
6,572,531 B2 6/2003 Zilberman et al.
6,592,512 B2 7/2003 Stöckert et al.
6,697,674 B2 2/2004 Leysieffer
6,707,920 B2 3/2004 Miller
6,736,770 B2 5/2004 Leysieffer et al.
6,754,537 B1 6/2004 Harrison et al.
6,786,860 B2 9/2004 Maltan et al.
6,788,790 B1 * 9/2004 Leysieffer ..... 381/60
6,807,445 B2 10/2004 Baumann et al.
6,826,430 B2 11/2004 Faltys et al.
6,855,104 B2 2/2005 Schmid et al.
2002/0138115 A1 9/2002 Baumann et al.
2002/0183587 A1 12/2002 Dormer

* cited by examiner

TOTALLY IMPLANTABLE HEARING SYSTEM

BACKGROUND OF THE INVENTION

The present application claims priority to the provisional patent application identified by the U.S. Ser. No. 60/555,201, which was filed on Mar. 22, 2004, the entire content of which is hereby expressly incorporated herein by reference.

STATEMENT REGARDING FEDERALLY SPONSORED RESEARCH AND DEVELOPMENT

Not Applicable.

BACKGROUND OF THE INVENTION

Ten percent of any population has sensorineural hearing loss. Of that 10%, about 4-5% get sufficient benefit from a hearing aid. The remainder is impaired in business, family and personal life. With the aging population, hearing impairment is increased.

Various hearing aid devices and methods have been developed to help those with hearing problems, such as behind-the-ear or in-the-ear hearing aids. However, such hearing devices suffer from problems such as wearing discomfort, user embarrassment or discrimination due to visibility by others, failures of mechanical parts, undesired background noise or noise resulting from the sudden movement or jarring of the user's head, misalignment of parts by the user (e.g., when a part of the hearing aid is positioned by the user in the ear canal), and loss or misplacement.

Thus there is a need for a hearing system which efficiently and effectively overcomes the above mentioned problems. It is to such a hearing system, and methods for making and using the same, that the present invention is directed.

DETAILED DESCRIPTION OF THE INVENTION

In general, the present invention relates to a hearing system for improving hearing in a user. More particularly, the present invention relates to an implantable hearing system for middle ear amplification. In one preferred embodiment, all of the elements of the hearing system of the present invention are constructed such that they are totally implantable in the user. Such a system is generally referred to herein as a "totally implantable hearing system" or TIHS. However, it should be understood that due to economic and/or technological considerations, the present invention contemplates that portions of the hearing system may be, in whole or in part, external to the user.

The term "biocompatible" as used herein refers to the property of being biologically compatible by being substantially inert, that is by not producing a toxic, injurious, or immunological response in living tissue. Examples of biocompatible materials include, but are not limited to, ceramics, polymers, alloplastic materials, autograft materials, titanium, titanium alloy, silicone elastomer, silicone adhesive, aluminum oxide, gold, stainless steel, fluoro resin, epoxy resin, polyparaxylylene, polyester, titanium polyparaxylylene, nylonpolytetrafluoreoethylene, polyurethane, and tecothane.

Figure 1:
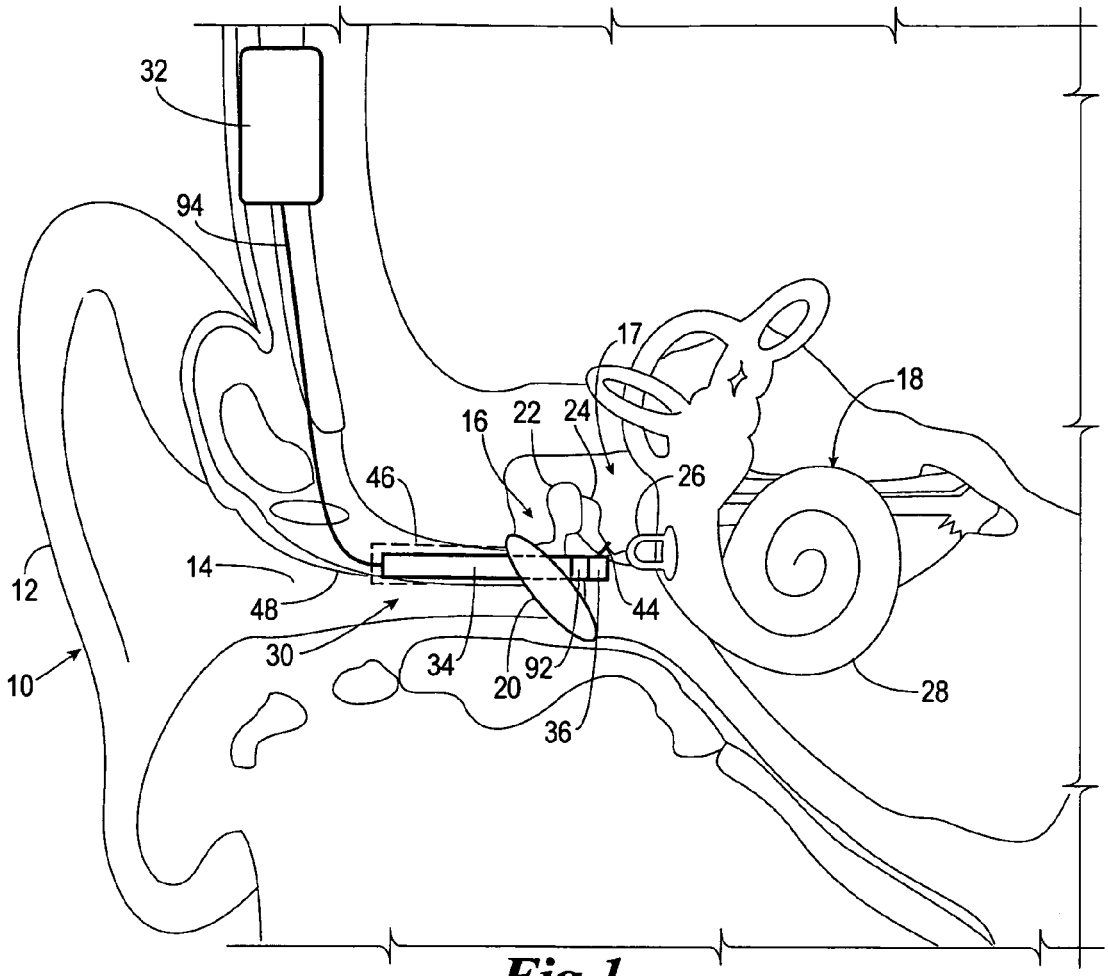
FIG. 1 is a cross sectional view of the human ear showing the implanted hearing system of the present invention.

Referring now to the figures, shown in FIG. 1 is a human ear designated by general reference numeral 10. The ear 10 includes an outer ear 12, an outer ear canal 14, a middle ear 16 having a middle ear space 17, an inner ear 18, a tympanic membrane ("eardrum") 20 and ossicles in the middle ear 16 which include a malleus 22, an incus 24, and a stapes 26 which is operatively connected to a cochlea 28 of the inner ear 18. The malleus 22, incus 24 and stapes 26 are also referred to herein as "ossicles 22-26."

Also shown in FIG. 1 and designated therein by the general reference numeral 30 is a totally implantable hearing system (TIHS). The TIHS 30 includes a sound processing device 32, a coil assembly 34, and a magnet assembly 36. In general, the magnet assembly 36 is implanted within the middle ear 16 of a user and preferably is attached to a portion of the incus 24 and/or stapes 26 of the middle ear 16. The sound processing device 32 is located on or implanted within the user so that sound normally perceived by the user can be received by the sound processing device 32. The sound processing device 32 converts the sound into electrical signals which are transmitted to the coil assembly 34. In response thereto, the coil assembly 34 generates electromagnetic signals which are transmitted to the magnet assembly 36. The interaction between the electromagnetic signals transmitted by the coil assembly 34 and the magnet assembly 36 causes the magnet assembly 36 to vibrate, thereby stimulating the incus 24 and stapes 26 in a manner known in the art to replicate the functioning of a normal inner ear 18 so that the user has the perception of sound.

Figure 2:
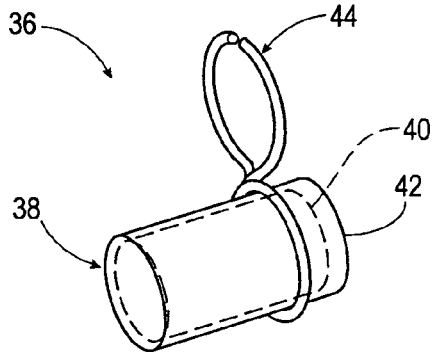
FIG. 2 is a perspective view of a magnet assembly of the hearing system which is constructed in accordance with the present invention.

As noted above, the magnet assembly 36 of the TIHS 30 is implantable in the middle ear 16 of the user such that the magnet assembly 36 is in contact with at least a portion of an ossicle 22-26 of the middle ear 16. In one embodiment, the magnet assembly 36 is attached to the incus 24 and/or the stapes 26 in a manner known to a person of ordinary skill in the art. As shown in FIG. 2, the magnet assembly 36 includes a magnetic device 38 for receiving the electromagnetic signals from the coil assembly 34 and for causing the vibration of one or more of the ossicles 22-26 in response to such electromagnetic signals. In one embodiment, the magnetic device 38 includes a permanent magnet 40 (shown in phantom) that provides a magnetic field which interacts with the electromagnetic signals transmitted by the coil assembly 34. In one embodiment, the permanent magnet 40 is a rare earth magnet comprising Neodymium-Iron-Boron, for example. Other materials used to construct the permanent magnet 40 are well known in the art. The permanent magnet 40 is preferably encased in a casing 42 constructed of a biocompatible material, such as described above, so that it can be safely implanted within the middle ear 16. For example, the casing 42 can be a hermetically sealed, titanium canister.

The magnet assembly 36 can connect to the one or more ossicles 22-26 of the middle ear 16 by any suitable means known to those of ordinary skill in the art so long as the magnet assembly 36 is capable of vibrating the one or more ossicles 22-26 in response to the electromagnetic signal transmitted by the coil assembly 34. For example, the magnet assembly 36 can include a securing device 44 comprising for example a clamp, ring, or adhesive such as shown or discussed in U.S. Pat. No. 4,776,322 and U.S. Pat. No. 5,913,815, both of which are incorporated by reference herein in their entireties.

In one embodiment, the magnet assembly 36 is an implant magnet obtainable from Soundtec Inc. of Oklahoma City, Okla. As another example of a suitable magnet assembly 36, further details of a vibration generating means can be found in U.S. Pat. Nos. 4,776,322 and 5,913,815 cited above.

As noted above, the coil assembly 34 of the TIHS 30 receives the electrical signals from the sound processing device 32 via a wire or other transmitting device known in the art and converts the electrical signals into electromagnetic signals. The electromagnetic signals are transmitted by the coil assembly 34 into the middle ear 16 of the user so as to interact with the magnetic field of the magnet assembly 36, thereby causing mechanical vibration or displacement of the magnet assembly 36 as discussed previously.

Preferably, the coil assembly 34 is adapted to be implanted into a trough 46 (shown in phantom) drilled into a portion of a bony canal wall 48 (preferably a posterior superior portion thereof adjacent the outer ear canal 14 of a user. Thus, an advantage of the TIHS 30 is that the outer ear canal 14 is left open and no uncomfortable occlusion effect is experienced by the user. It is also preferred that the coil assembly 34 be positioned in the bony canal wall 48 such that at least a portion of the coil assembly 34 extends into the middle ear space 17 of the middle ear 16 of the user wherein a distal tip 50 of the coil assembly 34 can be positioned in close proximity to the magnet assembly 36.

The distance between the distal tip 50 of coil assembly 34 and the magnet assembly 36 preferably depends on the strength or electromagnetic flux density of the electromagnetic signals transmitted by the coil assembly 34. Generally, the coil assembly 34 will be positioned so as to generate the most effective magnetic interaction between the coil assembly 34 and the magnet assembly 36. In one embodiment, the coil assembly 34 is positioned such that the distal tip 50 of the coil assembly 34 is spaced a lateral distance from the magnet assembly 36 in a range of about 1.0 millimeters to about 4.0 millimeters, and preferably about 1.0 millimeters to about 2.5 millimeters, and more preferably 1.5 millimeters to about 2.0 millimeters.

Figure 3:
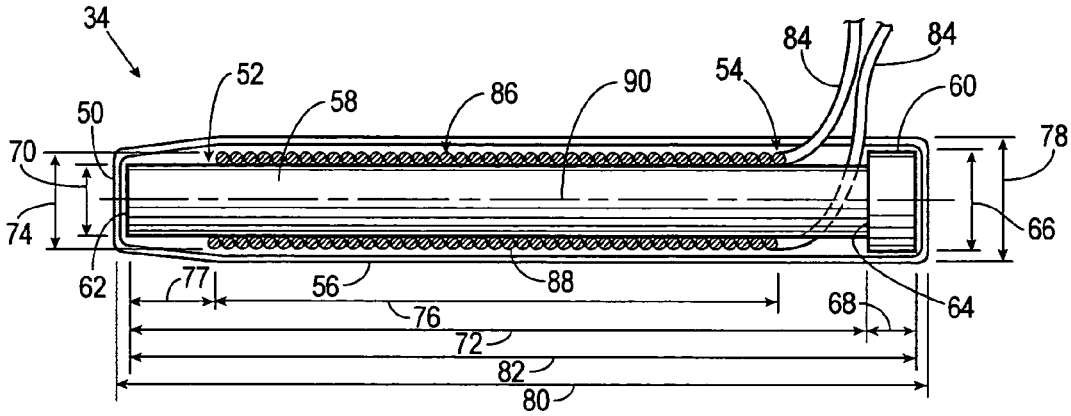
FIG. 3 is a side cross sectional view of a coil assembly of the hearing system which is constructed in accordance with the present invention.

In one embodiment, the coil assembly 34 of the TIHS 30 includes a core structure 52 and a coiled wire structure 54, as shown in FIG. 3. Further, to allow the coil assembly 34 to be implantable, the coil assembly 34 further comprises a biocompatible coil assembly casing 56 which encases the core structure 52 and coiled wire structure 54. For example, the coil assembly casing 56 can be a hermetically sealed titanium canister or any other biocompatible material such as described above which allows the coil assembly 34 to function in accordance with the present invention.

The core structure 52 of the coil assembly 34 is preferably constructed of a ferromagnetic material which exhibits a high magnetic permeability characteristic. In one embodiment, the core structure 52 is constructed of a material having a relative permeability constant ($\mu_r$) in the range of about 10,000, to about 40,000, to about 50,000, to about 60,000, to about 70,000, to about 80,000, to about 90,000, to about 100,000, and preferably having a relative permeability constant ($\mu_r$) of about 65,000 to about 75,000, and more preferably about 70,000 to about 72,000. For example, the core structure 52 can be constructed of a high-$\mu$ material, such as a nickel-iron-molybdenum alloy material, having a permeability of about $\mu_r$=71,483, which is obtainable from Mu Shield Company of Londonderry, N.H.

In one embodiment, as shown in FIG. 3, the core structure 52 of the coil assembly 34 includes a core arm 58 and a core tail 60. The core arm 58 preferably has a substantially cylindrical shape with a first end 62 at the distal tip 50 of the coil assembly 34, and a second end 64 adjacent the core tail 60. The first end 62 of the core arm 58 is positioned so as to be disposed near the magnet assembly 36. The core tail 60 of the core structure 52 is disposed near the second end 64 of the core arm 58. Preferably the core arm 58 and core tail 60 are integrally connected. In one embodiment, the core tail 60 also has a substantially cylindrical shape, and an outer diameter of the core tail is greater than an outer diameter of the core arm 58. In other words, for such an embodiment the core structure 52 has a generally "T" shape structure when viewed from the side.

In preferred embodiments, the core tail 60 has a diameter 66 of about 0.2 millimeters to about 1.2 millimeters and a length 68 of about 0.0 millimeters to about 2.0 millimeters. The core arm 58 has a diameter 70 of about 0.2 millimeters to about 0.8 millimeters and a length 72 of about 5 millimeters to 14 millimeters. The coiled wire structure 54 has an outer diameter 74 of about 0.6 millimeters to about 1.2 millimeters and a length 76 of about 6 millimeters to about 10 millimeters. A distance 77 between the first end 62 of the core arm 58 and the coiled wire structure 54 is about 0.0 millimeters to about 2.0 millimeters. The coil assembly 34 has a maximum diameter 78 of about 1.5 millimeters to about 2.0 millimeters and an overall length 80 of about 7 millimeters to about 18 millimeters, which includes the coil assembly casing 56. The core structure 52 has a length 82 which includes the core arm length 72 and the core tail length 68.

The coiled wire structure 54 of the coil assembly 34 is the current-carrying portion of the coil assembly 34 and is adapted to receive the electrical signal from the sound processing device 32 as noted above. The coiled wire structure 54 includes a conductive wire 84. In one embodiment, the conductive wire 84 is a copper wire preferably having a wire gauge in a range of about a #43 gauge (or about 0.066 mm diameter, and a 7.03 ohm/m resistivity) to about a #50 gauge (or about 0.031 mm diameter, and a 34.71 ohm/m resistivity), and preferably is a copper wire having a #46 wire gauge (or about 0.047 mm diameter and a 13.80 ohm/m resistivity). For example, the conductive wire 84 can be a #46 gauge copper wire obtainable from MWS Wire Industry of Westlake Village, Calif. It will be understood by a person of ordinary skill in the art that the invention is not limited to the wire gauge or electrical characteristics shown above.

A portion of the conductive wire 84 is wrapped around the core structure 52 so as to form a coil portion 86 in the coiled wire structure 54. The coil portion 86 has a plurality of turns 88. When the conductive wire 84 receives the electrical signals from the sound processing device 32, the electromagnetic signals are induced and transmitted generally along a central axis 90 of the core structure 52 toward the magnetic assembly 36 of the TIHS 30. In one embodiment, the coil portion 86 of the coiled wire structure 54 of the coil assembly 34 is formed around the core arm 58 of the core structure 52 by helically wrapping or winding the conductive wire 84 around the core arm 58 from near the second end 64 to near the first end 62 of the core arm 58, and then from near the first end 62 to near the second end 64 of the core arm 58 such that terminal ends of the conductive wire 84 are disposed near the second end 64 of the core arm 58, and the turns 88 of the coil portion 86 of the conductive wire 84 extend from generally between the first end 62 and the second end 64 of the core arm 58.

Preferably, the coil assembly 34 is positioned such that the central axis 90 of the coil assembly 34 (or the axis along which the electromagnetic field strength is generally concentrated) is aligned substantially parallel with the magnetic dipole of the magnetic assembly 36. However, the central axis 90 of the coil assembly 34 can be at a relative angle to the dipole of the magnetic assembly 36. In one embodiment, the central axis 90 of the coil assembly 34 is at a relative angle of less than or equal to about twenty degrees from the dipole of the magnetic assembly 36. Further, the coil assembly 34 is preferably positioned such that the central axis 90 of the coil assembly 34 is substantially aligned with the dipole of the magnetic assembly 36. However the coil assembly 34 can be spaced vertically from the magnetic assembly 36. As such, the coil assembly 34 can be disposed above or below the magnet assembly 36 (and/or ossicies 22-26). In one embodiment, the coil assembly 34 is spaced vertically from the magnetic assembly 36 at a distance of less than or equal to about 2 millimeters.

In one embodiment, the coil assembly 34 is implanted in the user utilizing a transcanal surgical implantation method. During such a surgical procedure, a tympanomeatal incision is made, and the tissue flap elevated to the fibrous annulus. The trough 46 (shown in phantom in FIG. 1) is drilled from lateral to medial along the bony canal wall 48, preferably in a posterior superior portion thereof. Preferably, the trough 46 opens to the middle ear space 17 of the middle ear 16 so that the coil assembly 34 can be positioned in the trough 46 such that at least a portion of the coil assembly 34 protrudes into the middle ear space 17.

The trough 46 preferably is dimensioned so as to correspond generally to the dimensions of the coil assembly 34. For example, the trough 46 is preferably approximately 2 to 3 millimeters in diameter when the diameter 78 of the coil assembly 34 is approximately 1.5 to 2.0 millimeters. Once the trough 46 is formed in the bony canal wall 48, the coil assembly 34 is then placed in the trough 46 and preferably is fixed into position (e.g., by a biocompatible adhesive, cement, glue, clamp, ring, clasp or screw).

The protrusion of the coil assembly 34 in the middle ear space 17 generally improves the interaction between the electromagnetic signals transmitted by the coil assembly 34 and the magnetic field of the magnet assembly 36. Further, when the coil assembly 34 is positioned such that there are no tissue or bone barriers between the coil assembly 34 and the magnet assembly 36, the TIHS 30 can further include a spacer 92 which is disposed between the coil assembly 34 and magnet assembly 36, as shown for example in FIG. 1. The spacer 92 substantially maintains the lateral and/or vertical spacing between the distal tip 50 of the coil assembly 34 and the magnet assembly 36, while still allowing the magnet assembly 36 to vibrate the one or more ossicles 22-26 in response to the electromagnetic signals transmitted by the coil assembly 34.

By substantially maintaining an optimal or preferred spacing between the coil assembly 34 and the magnet assembly 36 (other than the variations due to the micron-scale movement of the magnet assembly 36 in response to the electromagnetic signals transmitted by the coil assembly 34 during operation), the spacer 92 further stabilizes the magnet assembly 36 within the middle ear 16. As such, the spacer 92 helps prevent movement of the magnet assembly 36 caused by movement of the user's head (e.g., by jarring or shaking of the user's head), which can result in undesired noise and/or discomfort. Further, the spacer 92 substantially prevents "drifting" of the magnet assembly 36 over time, which can be caused by the natural attraction and close proximity of the coil assembly 34 and the magnet assembly 36. Also, the spacer 92 can be used to ensure proper alignment during implantation and over the lifetime of the TIHS 30.

The spacer 92 is preferably connected to the coil assembly 34 and/or to the magnet assembly 36 and is preferably constructed of a biocompatible material, such as described above (for example a polymeric material), that will not significantly impede the transmission of the electromagnetic signals from the coil assembly 34 to the magnet assembly 36. In one embodiment, for example as shown in FIG. 1, the spacer 92 is connected to both the coil assembly 34 and to the magnet assembly 36. The connection between the spacer 92 and the coil assembly 34 can be substantially or partially fixed. However, the connection between the spacer 92 and the magnet assembly 36 must allow for the micron-scale movement of the magnet assembly 36 in response to the electromagnetic signals transmitted by the coil assembly 34 so that the magnet assembly 36 can effectively move at least one of the ossicles 22-26. For example, the spacer 92 can be adapted such that the spacer 92 connects or engages the magnet assembly 36 in a piston-like manner. Alternatively or additionally, the spacer 92 can be constructed of a material that is flexible enough to allow the spacer 92 to compress, expand, and/or shift at the connection between the spacer 92 and the magnet assembly 36 so as to allow for the movement of the magnet assembly 36. For example, at least a portion of the spacer 92 can be constructed of a flexible and/or elastic polymeric material.

As noted above, the interaction between the electromagnetic signals or fields induced by the coil assembly 34 and the magnetic field generated by the magnetic assembly 36 directly causes vibration of the magnetic assembly 36 (and the attached portion of the ossicles 22-26) to produce amplified sound perception in the user. As such, the electromagnetic coupling between the coil assembly 34 and the magnet assembly 36 characterizes the performance of the TIHS 30. In other words, the strength and distribution of the electromagnetic signals induced by the coil assembly 34 determines the function and affects the effectiveness of the movement of the magnet assembly 36.

Criteria which dictate the design of the coil assembly 34 include size, electromagnetic field strength (flux density B), and field distribution under anatomical and surgical restrictions. The size of the coil assembly 34 is generally constrained by the anatomy of the ear 10 and the bony canal wall 48 and surrounding areas. The flux density per unit current (B/i) under constant voltage is preferably maximized to provide superior current consumption for the coil assembly 34 in driving the magnet assembly 36. Further, the electromagnetic field strength will generally be concentrated along an axis, and will determine the approximate distance from the end of the coil assembly 34 to the magnetic assembly 36 which gives optimal interaction between the coil assembly 34 and the magnetic assembly 36.

As discussed above, the coil assembly 34 is preferably implanted within the bony canal wall 48 along the outer ear canal 14. As such, the coil assembly 34 should be sized and dimensioned accordingly. In one embodiment, the coil assembly 34 is constructed such that the overall diameter 78 of the coil assembly 34 (including the coil assembly casing 56) is 1.0 to 1.5 millimeters, and preferably does not exceed approximately 2.5 millimeters, and the overall length 80 of the coil assembly 34 preferably does not exceed approximately 18 millimeters. In one embodiment, to allow for the dimensions of the coil assembly casing 56, the core tail diameter 66 preferably does not exceed approximately 1.2-2.0 millimeters, and the length 82 of the core structure 52 preferably does not exceed approximately 15 millimeters. Taking such limitations into consideration, the other characteristics and relative dimensions of the core structure 52 and the coiled wire structure 54 of the coil assembly 34 can then adjusted to meet the other design criteria discussed above (for example as shown in Table I).

A computational method was used to experimentally model and evaluate the performance of the coil assembly 34 based on an embodiment of the coil assembly 34 having the core structure 52 with the core arm 58 and the core tail 60, and the coiled wire structure 54 (for example as shown in FIG. 3). In general, key parameters of the coil assembly 34 which generally affect the electromagnetic field strength of the coil assembly 34 include: (a) the structural or geometric parameters of the core structure 52 and the coiled wire structure 54; (b) the gauge of the conductive wire 84; (c) the material used to construct the core structure 52; (d) physical parameters of the coiled wire structure 54, such as resistance, inductance, and turns 88; and (e) function characteristics such as electromagnetic flux density and power consumption. While varying the design parameters in a computer assisted modeling system, the electromagnetic field induced by an AC current flowing through the coil assembly 34 and the corresponding power consumption were calculated.

Preferred parameters for the coil assembly 34, when the core structure 52 comprises a High-μ material and the conductive wire 84 of the coiled wire structure 54 is a #46 gauge copper wire, are shown in Table I.

TABLE I

Preferred Parameter Ranges of Coil Assembly.

| Parameter of Coil Assembly | Preferred Range (mm) |
|---|---|
| Core arm length | 5.0-14.0 |
| Core arm diameter | 0.2-0.8 |
| Core tail length | 0.0-2.0 |
| Core tail diameter | 0.2-1.2 |
| Coiled wire structure length | 6.0-10.0 |
| Coiled wire structure outer-diameter | 0.6-1.2 |

The number of turns 88 of the coil portion 86 of the coiled wire structure 54 also affects the electromagnetic field strength of the coil assembly 34. In preferred embodiments, the coil portion 86 has from about 1100 turns 88 to about 1900 turns 88, with a typical design having about 1300-1400 turns 88, and more preferably having about 1380 turns 88. The functional characteristics of resistance, inductance, electromagnetic flux density, and power consumption associated with about 1300 turns is about 35 ohms, about 0.4 mH, about 10 Gauss, and about $20\times10^{-6}$ W, respectively, in a coil portion 86 having a #46 wire gauge. The functional characteristics of resistance, inductance, electromagnetic flux density, and power consumption associated with about 1900 turns is about 100 ohms, about 3.0 mH, about 25 Gauss, and about $45\times10^{-6}$ W, respectively. The functional characteristics of resistance, inductance, electromagnetic flux density, and power consumption associated with about 1380 turns is about 76 ohms, about 2.4 mH, about 23 Gauss, and about $22.33\times10^{-6}$ W, respectively.

In one embodiment, the coil assembly 34 is constructed such that the length 72 of core arm 58 is about 9.3 millimeters, the diameter 70 of the core arm 58 (i.e., an approximate inner diameter of the coil portion 86) is about 0.4 millimeters, the length 68 of the core tail 60 is about 1.0 millimeters, the diameter 66 of the core tail 60 is about 1.0 millimeters, the outer diameter 74 of the coiled wire structure 54 is about 1.2 millimeters, the length 76 of the coiled wire structure 54 is about 8.1 millimeters (and consists of about 1725 turns 88), and the distance 77 between the first end 62 of the core arm 58 and coiled wire structure 54 is about 0.2 millimeters. Such an embodiment has a resistance of about 78.9 ohms and an inductance of about 2.25 mH.

In another embodiment, the coil assembly 34 is constructed such that the length 72 of core arm 58 is about 10.0 millimeters, the diameter 70 of the core arm 58 is about 0.4 millimeters, the length 68 of the core tail 60 is about 1.0 millimeters, the diameter 66 of the core tail 60 is about 1.0 millimeters, the outer diameter 74 of the coiled wire structure 54 is about 1.14 millimeters, the length 76 of the coiled wire structure 54 is about 8.0 millimeters (and consists of about 1786 turns 88), and the distance 77 between the first end 62 of the core arm 58 and the coiled wire structure 54 is about 1.0 millimeters. Such an embodiment has a resistance of about 79.3 ohms and an inductance of about 9.00 mH.

In one embodiment, the coil assembly 34 is electrically connected to the sound processing device 32 via a transmission link 94 (see FIG. 1). In one embodiment, the transmission link 94 is a wire covered by a biocompatible polymeric material as described elsewhere herein, which connects the sound processing device 32 to the coiled wire structure 54 of the coil assembly 34. Preferably, the sound processing device 32 of the TIHS 30 is adapted so as to be totally implantable. For example, in one embodiment, the sound processing device 32 is adapted to be implanted in a portion of the skull of the user, such as the mastoid area of the temporal bone of the skull near the ear 10, so as to give a more accurate perception of sound that would normally be received at the ear 10 of the user.

The sound processing device 32 receives and converts sound into electrical signals, and amplifies the electrical signals which are then transmitted via the transmission link 94 to the coil assembly 34 to move the magnet assembly 36 as described previously. The processed electrical signals are generally in the form of AC current of varying frequencies, and are transmitted to the coil assembly 34 to induce the electromagnetic signals which are transmitted by the coil assembly 34 to the magnet assembly 36.

Figure 4:
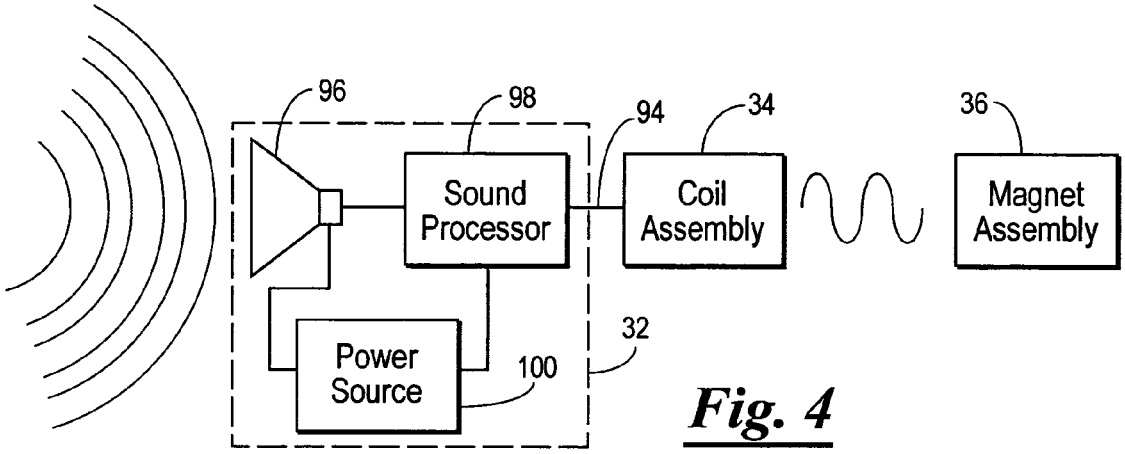
FIG. 4 is a block diagram representation of one embodiment of the hearing system of the present invention.

In one embodiment, as shown in FIG. 4, the sound processing device 32 includes a microphone 96 and a sound processor 98 which cooperate to convert sound into the electrical signals transmitted to the coil assembly 34. In general, the microphone 96 is a transducer or input device which is positioned to sense acoustic sound waves or vibrations, and then convert the sound waves received into an electrical signal which is transmitted to the sound processor 98. The sound processor 98 processes and amplifies the electrical signal output by the microphone 96 to match the individual output requirements of the user. In other words, the sound processor 98 processes and amplifies the electrical signal such that the electrical signal output by the sound processor 98 induces the coil assembly 34 to move the magnet assembly 36 as described above.

The sound processing device 32 of the TIHS 30 further includes a power source 100 connected to the microphone 96 and sound processor 98. In one non-limiting embodiment, the power source 100 supplies a voltage of about 1.3V. Because it is preferred that the sound processing device 32 be totally implantable, the power source 100 preferably is a rechargeable battery which can be recharged by a remote control unit (not shown). For example, the power source 100 can include one or more lithium ion rechargeable batteries obtainable from Wilson Greatbatch Technologies, Inc. of Clarence, N.Y.

An example of a device and process for charging rechargeable batteries of implants can be found in U.S. Pat. No. 6,227,204, and an example of a casing or housing which houses a battery can be found in U.S. Pat. No. 6,736,770; the entire contents of which are hereby expressly incorporated herein by reference.

In one embodiment, the microphone 96, the sound processor 98, and the power source 100 of the sound processing device 32 are contained within a biocompatible housing 102 (see FIG. 5) so as to be readily implantable in the user as a unit. For example, the housing 102 can be a titanium can which is adapted to be implanted under the mastoid process behind the ear 10. While the microphone 96, the sound processor 98, and the power source 100 can be included in the same housing 102, the present invention contemplates that each of the microphone 96, sound processor 98, the power source 100, or portions or combinations thereof, can be contained in one or more separate housings 102. For example, the microphone 96 can be disposed in a separate housing and implanted in the user's outer ear canal 14, while the sound processor 98 and power source 100 are disposed in another housing and implanted in the mastoid area behind the user's ear 10. An arrangement of positioning a microphone in the ear canal 14 can be found for example in U.S. Pat. No. 5,814,095 and U.S. Published Patent Application No. 2002/0138115; the entire contents of which are hereby expressly incorporated herein by reference.

Figure 5:
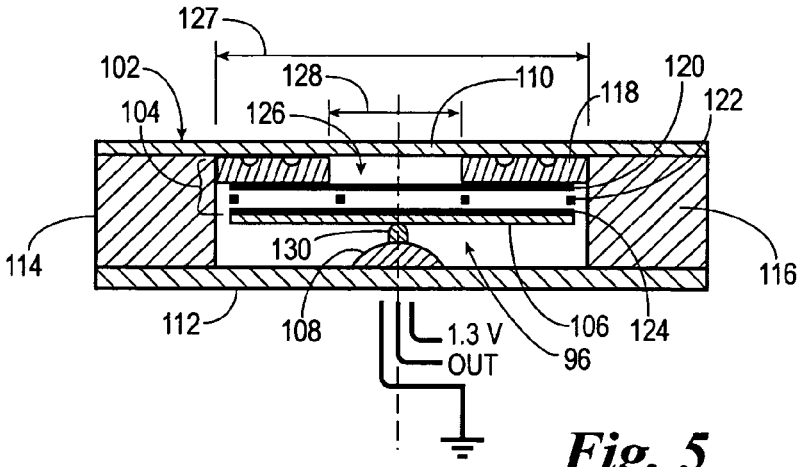
FIG. 5 is a side cross sectional view of one embodiment of a microphone of the hearing system which is constructed in accordance with the present invention.

As shown in FIG. 5, in one embodiment, the microphone 96 of the sound processing device 32 includes a diaphragm assembly 104, a backplate 106, and a preamplifier circuit 108, which are disposed in the housing 102. As shown in FIG. 5, in one embodiment the housing 102 includes a titanium front cover 110, a back cover 112, and housing sidewalls 114 and 116 which are disposed between the front cover 110 and back cover 112.

The diaphragm assembly 104 of the microphone 96 includes a diaphragm ring 118, a diaphragm 120, a plurality of wire spacers 122, and an electret film 124, as shown for example in FIG. 5. The diaphragm 120 vibrates in response to the sound waves impinging thereon. The diaphragm ring 118 supports the diaphragm 120 and further spaces the diaphragm 118 from the front cover 110 of the housing 102. The wire spacers 122 support the diaphragm 120 and space the diaphragm 120 from the backplate 106.

In general, the parameters of the diaphragm assembly 104 of the microphone 96 depend on placement of the microphone 96, human skin transmissibility, the biomaterial properties of materials used to construct the microphone 96, the effect of the front cover 110 of the housing 102, a space 126 between the front cover 110 of the housing 102 and the diaphragm 120 of the microphone 96, the acoustic volume of the sound being received, and environmental conditions.

In one embodiment, the diaphragm 120 is constructed of a thin biocompatible polymer or mylar material (obtainable from Sheldahl, Inc. of Northfield, Minn, for example) which is coated on one side with a metal, such as gold or nickel. The diaphragm ring 118 is cemented or otherwise connected to the metal side of the diaphragm 120. The diaphragm ring 118 has an outer diameter 127 of about 18 millimeters, and an inner diameter 128 of about 8 millimeters (such that the diaphragm 120 has a corresponding effective diameter of about 8 millimeters). The diaphragm ring 118 has a thickness of about 0.5 millimeters. The diaphragm ring 118 and the diaphragm 120 are positioned within the housing 102 such that the diaphragm 120 is spaced about 1.10-1.15 millimeters, and preferably about 1.13 millimeters, from the front cover 110. The electret film 124 is made of a fluoropolymer material (such as "TEFLON" obtainable from Dupont of Wilmington, Del., for example) and is laminated to the backplate 106. The wire spacers 122 are insulated copper wires having a diameter of about 0.025 millimeters, and are connected to the electret film 124 and backplate 106 by an epoxy staking compound (such as "TRA-BOND 2116" obtainable from Tra-Con, Inc. of Bedford Mass., for example). The distance between the diaphragm 120 and the backplate 106 generally corresponds to the size of the wire spacers 122.

The backplate 106 of the microphone 96 serves as an electrode in close proximity to the diaphragm 120. The backplate 106 is disposed adjacent to the electret film 124 of the diaphragm assembly 104, and is electrically connected to the preamplifier circuit 108 via an electrical contact 130. In one embodiment, the backplate 106 is a brass sheet with a thickness of about 0.1 millimeters.

Figure 6:
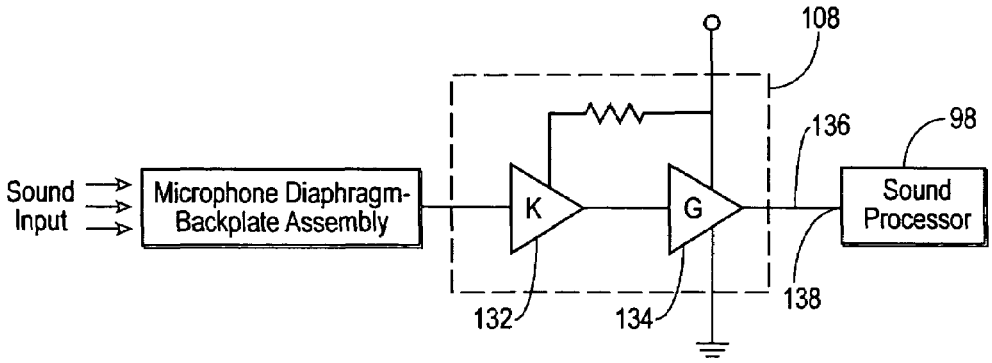
FIG. 6 is a schematic of one embodiment of a preamplifier circuit of the microphone of the hearing system which is constructed in accordance with the present invention.

The preamplifier circuit 108 of the microphone 96 amplifies the signal strength of the electrical signal from the electret film 124 before the electrical signal is transmitted to the sound processor 98. In one embodiment, to overcome the skin-attenuation effect on sound transmission for the implantable microphone 96, the preamplifier circuit 108 includes a buffer amplifier 132 and voltage gain amplifier 134, an output 136 of which is connected to an input 138 of the sound processor 98, as shown in FIG. 6. In general, the buffer amplifier 132 serves to eliminate noise and improve signal quality, and the voltage gain amplifier 134 provides voltage gain in the signal. The buffer amplifier 132 can be for example a JFET or low noise semiconductor type amplifier obtainable from Knowles Electronics, Inc. of Itasca, Ill. The voltage gain amplifier 134 can be for example an operational amplifier obtainable from Gennum Corporation of Ontario, Canada.

Another example of a suitable microphone 96 can be found in U.S. Pat. No. 6,707,920, the entire content of which is hereby expressly incorporated herein by reference.

Figure 7:
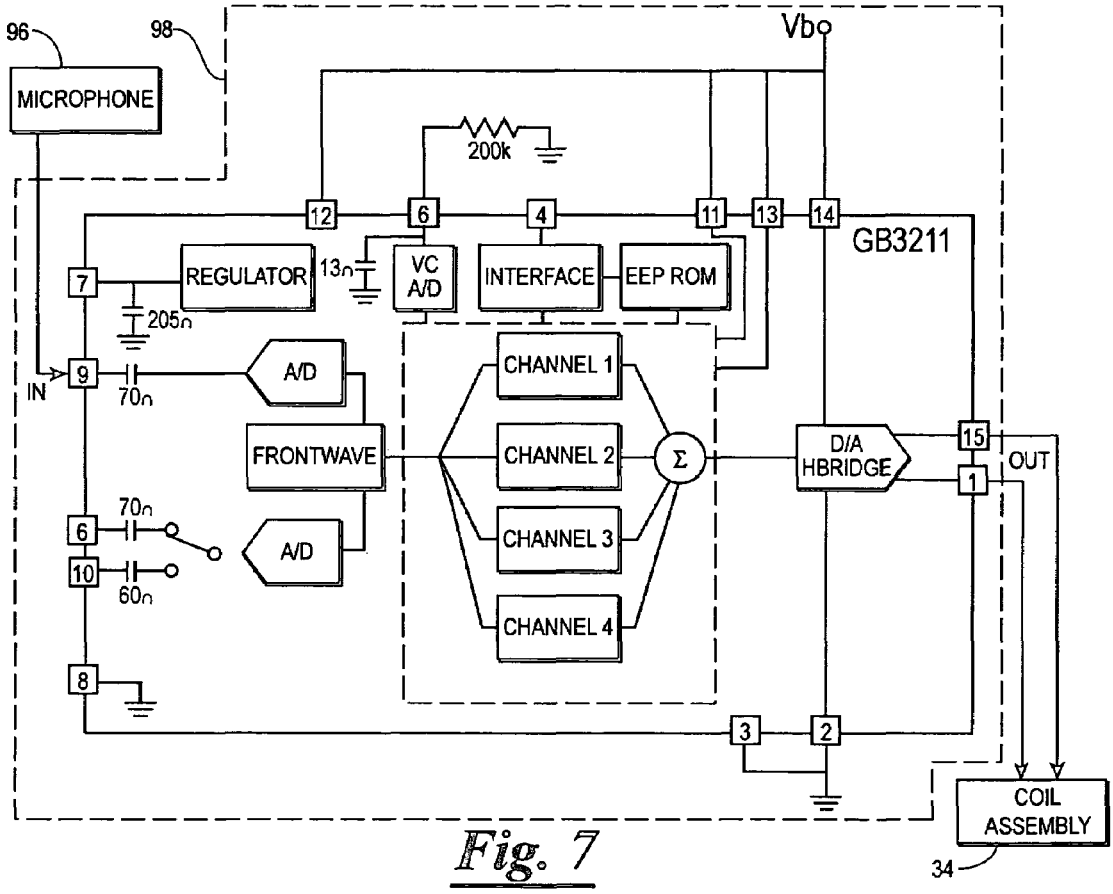
FIG. 7 is a schematic of one embodiment of a sound processor of the hearing system which is constructed in accordance with the present invention.

The sound processor 98 of the sound processing device 32 receives the output signal of the microphone 96, and processes and further amplifies the signal to generate the electrical signal transmitted to the coil assembly 34. Preferably, the signal from the microphone 96 is processed in a digital manner in a digital signal process utilizing software. In one embodiment, the sound processor 98 processes the signal from the microphone 96 utilizing a multi-channel digital signal processing (DSP) technique. For example, the sound processor 98 can include a multi-channel DSP chip such as chip number GB3211, obtainable from Gennum Corporation of Ontario, Canada, which is shown in FIG. 7. The DSP chip GB3211 has an internal memory which can store up to four sets of preprogrammed parameters.

In one embodiment, the sound processor 98 utilizes a four channel DSP chip (however it should be understood that a different number of channels can be used in accordance with the present invention). For each channel, the parameters are used to define a lower threshold, a low level gain, an upper threshold, and a high level gain. In general, the channel settings should be optimized based on the frequency response and input-output relationship of the DSP function of the sound processor 98, as well as the effectiveness of the sound processor 98 in relation to the interaction between coil assembly 34 and magnet assembly 36 (resulting from the electrical signals transmitted by the sound processing device 32 to the coil assembly 34). The DSP chip GB3211 discussed above has the capacity to produce a number of desirable frequency response curves within the audio frequency range. In one embodiment, to generate a frequency response curve having a gain of about 40 dBV at frequencies of about 1000 Hz, the parameters were set as follows: Channel 1 had a lower threshold of about −90 dB, a low level gain of about −18 dB, an upper threshold of about −30 dB, and a high level gain of about −18 dB (resulting in a compression ratio of 1.:1); Channel 2 had a lower threshold of about −90 dB, a low level gain of about −18 dB, an upper threshold of about −30 dB, and a high level gain of about −18 dB (resulting in a compression ratio of 1.1); Channel 3 had a lower threshold of about −90 dB, a low level gain of about 22 dB, an upper threshold of about 40 dB, and a high level gain of about −16 dB (resulting in a compression ratio of 1.14:1); and Channel 4 had a lower threshold of about −90 dB, a low level gain of about 18 dB, an upper threshold of about 40 dB, and a high level gain of about 18 dB (resulting in a compression ratio of 1.:1).

Further, the sound processor 98 is preferably adapted to be programable wirelessly so that the sound processor 98 can be remotely controlled and adjusted after the sound processing device 32 has been implanted in the user. For example, radio frequency (RF) telemetry or other telemetry techniques can be utilized to adjust the electric signal transmitted by the sound processor 98 to the coil assembly 34.

Figure 8:
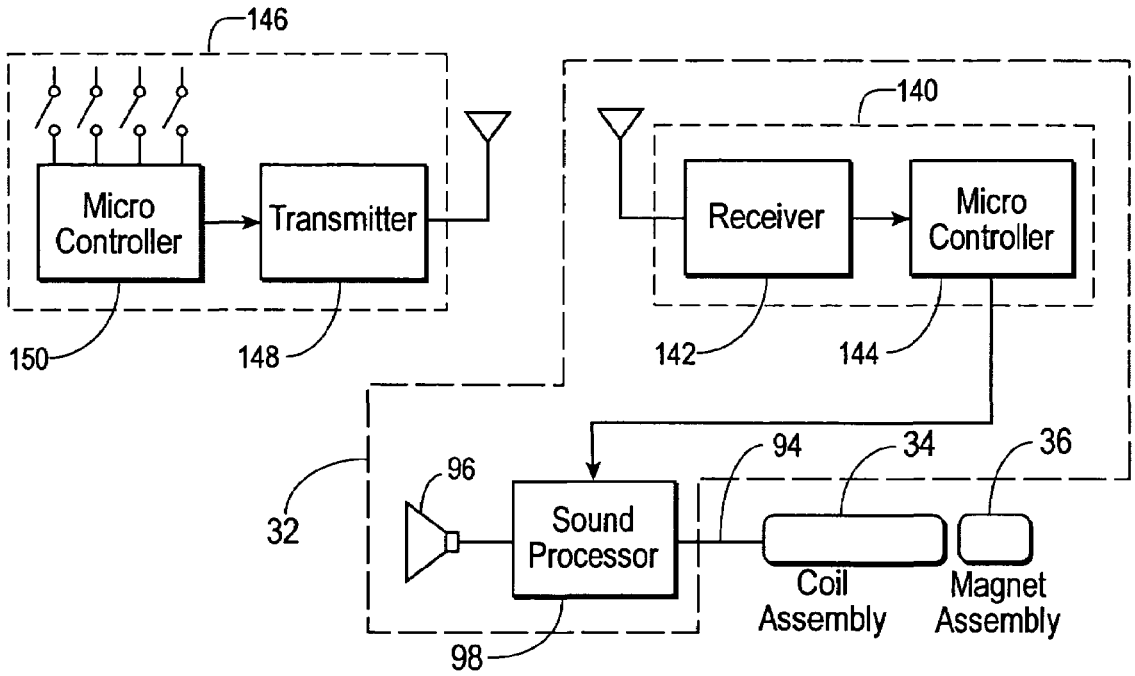
FIG. 8 is a block diagram representation of one embodiment of a receiver assembly of the hearing system which is constructed in accordance with the present invention.

In one embodiment, as shown for example in FIG. 8, the sound processing device 32 further includes a receiver assembly 140 having a radio frequency signal receiver 142 and a microcontroller 144, the output of which is provided as an input to the sound processor 98. A transmitter assembly 146 having a radio frequency signal transmitter 148 and a microcontroller 150, which is external to the user, can be used to transmit a radio frequency signal to the receiver assembly 140 so that the receiver assembly 140 can output an electrical signal to the sound processor 98. For example, the receiver 142 of the receiver assembly 140 and the transmitter 148 of the transmitter assembly 146 can be digital FM, short range, or ISM band transceivers, for example.

The microcontroller 144 of the receiver assembly 140 is programmed to properly interface with the sound processor 98, and the microcontroller 150 of the transmitter assembly 146 can be programmed to properly interface with an input means (not shown) from which a audiologist, acoustician, technician, or physician, for example, can set the desired input to be transmitted to the sound processor 98 via the receiver assembly 140 and transmitter assembly 146. By being able to adjust the sound processor 98 remotely, the TIHS 30 can be adapted to the particular hearing needs of an individual user at any given point in time without the need for further surgery.

While various embodiments in accordance with the present invention have been shown and described herein, it should be understood that the invention is not limited thereto, and is susceptible to numerous changes and modifications to the elements, devices, and/or steps of the methods without departing from the spirit and the scope of the invention as defined in the following claims.

What is claimed is:

1. A hearing system for improving a user's hearing, comprising:

a sound processing device adapted to receive and convert sound into an electrical signal;

a coil assembly for receiving the electrical signal from the sound processing device and converting the electrical signal into an electromagnetic signal and wherein the coil assembly is sized to be implanted in a trough within a bony canal wall of the user adjacent to and separate from an ear canal of the user, wherein the coil assembly comprises:

(a) a core structure constructed of a material having a high magnetic permeability, the core structure comprising a core arm having a first end and a second end, and a core tail which extends from the second end of the core arm and wherein the core tail has an outer diameter which is greater than an outer diameter of the core arm, and (b) a coiled wire structure adapted to receive the electrical signal from the sound processing device, wherein at least a portion of the coiled wire structure is positioned about at least a portion of the core arm of the core structure forming a coil portion such that when the coiled wire structure receives the electrical signal, the electromagnetic signal is induced in the coil portion; and a magnet assembly adapted to be positioned within a middle ear of an ear of the user and in contact with at least a portion of at least one ossicle within the middle ear, wherein the magnet assembly is vibratingly responsive to the electromagnetic signal induced in the coil portion and transmitted by the coil assembly.

2. The hearing system of claim 1, wherein the hearing system is totally implantable within the user.

3. The hearing system of claim 1, wherein the coil assembly can be positioned in the bony canal wall such that at least a portion of the coil assembly protrudes from the bony canal wall into a middle ear space of the middle ear of the user.

4. The hearing system of claim 1, wherein the ossicle in contact with the magnet assembly is an incus.

5. The hearing system of claim 1, wherein the ossicle in contact with the magnet assembly is a stapes.

6. The hearing system of claim 1, wherein the ossicles in contact with the magnet assembly are an incus and a stapes.

7. The hearing system of claim 1, wherein the coil assembly can be positioned such that a distal tip of the coil assembly is spaced a distance of about 1 millimeter to about 4 millimeters from the magnet assembly.

8. The hearing system of claim 1, further comprising a spacer engaged with at least one of the magnet assembly and the coil assembly and disposed between the coil assembly and the magnet assembly such that the spacer substantially maintains a spatial separation between the magnet assembly and the coil assembly while allowing for the magnet assembly to vibrate the ossicle in response to the electromagnetic signal transmitted by the coil assembly.

9. The hearing system of claim 1, wherein the coil assembly further comprises a biocompatible casing adapted to house at least a portion of the core structure and at least a portion of the coiled wire structure.

10. The hearing system of claim 1, wherein the core arm has a length in a range of about 5.0 millimeters to about 14.0 millimeters.

11. The hearing system of claim 1, wherein the core tail has a length up to about 2.0 millimeters.

12. The hearing system of claim 1, wherein the outer diameter of the core arm has a range of about 0.2 millimeters to about 0.8 millimeters.

13. The hearing system of claim 1, wherein the outer diameter of the core tail has a range of about 0.2 millimeters to about 1.2 millimeters.

14. The hearing system of claim 1, wherein the coil portion has a length in a range of about 6.0 millimeters to about 10.0 millimeters.

15. The hearing system of claim 1, having a distance between the first end of the core arm and the coiled wire structure in a range of about 0.0 millimeters to about 2.0 millimeters.

16. The hearing system of claim 1, wherein the sound processing device is sized and adapted to be implanted in a portion of a skull of the user.

17. The hearing system of claim 16, wherein the sound processing device is sized and adapted to be implanted in a mastoid area of a temporal bone near the ear of the user.

18. The hearing system of claim 1, wherein the sound processing device comprises a microphone for receiving sound waves, and a sound processor electrically connected to the microphone, wherein the microphone and sound processor cooperate to convert the sound waves received by the microphone into the electrical signal transmitted to the coil assembly.

19. The hearing system of claim 18, wherein the sound processing device further comprises a radio frequency signal receiver for receiving a radio frequency signal for adjusting the electric signal transmitted to the coil assembly by the sound processor.

20. The hearing system of claim 18, wherein the sound processing device further comprises a rechargeable battery.

21. The hearing system of claim 18, wherein the sound processing device further comprises a biocompatible housing for containing the microphone and the sound processor.

22. A method of enhancing a user's hearing by mechanically stimulating an ossicle in a middle ear of the user, comprising:

implanting in the user's skull a sound processing device adapted to receive and convert sound into an electrical signal;

implanting a coil assembly into an artificially created trough in a bony canal wall of the user adjacent to an ear canal of the user, the coil assembly for receiving the electrical signal from the sound processing device and converting the electrical signal into an electromagnetic signal, wherein the coil assembly comprises:

(a) a core structure constructed of a material having a high magnetic permeability, the core structure comprising a core arm having a first end and a second end, and a core tail which extends from the second end of the core arm and wherein the core tail has an outer diameter which is greater than an outer diameter of the core arm, and (b) a coiled wire structure adapted to receive the electrical signal from the sound processing device, wherein at least a portion of the coiled wire structure is positioned about at least a portion of the core arm of the core structure forming a coil portion such that when the coiled wire structure receives the electrical signal, the electromagnetic signal is induced in the coil portion; and implanting in the middle ear of the user a magnet assembly and attaching the magnet assembly to at least a portion of at least one ossicle within the middle ear, wherein the magnet assembly is vibratingly responsive to the electromagnetic signal induced in the coil portion and transmitted by the coil assembly for causing vibrations in the ossicle.

23. The method of claim 22, wherein the hearing system is totally implanted within the user.

24. The method of claim 22, wherein the coil assembly is positioned in the bony canal wall such that at least a portion of the coil assembly protrudes from the bony canal wall into a middle ear space of the middle ear of the patient.

25. The method of claim 24, further comprising disposing a spacer between the magnet assembly and the coil assembly which engages at least one of the magnet assembly and the coil assembly such that the spacer substantially maintains a spatial separation between the magnet assembly and the coil assembly while allowing for the magnet assembly to vibrate the ossicle in response to the electromagnetic signal transmitted by the coil assembly.

26. The method of claim 22, wherein the ossicle attached to the magnet assembly is an incus.

27. The method of claim 22, wherein the ossicle attached to the magnet assembly is a stapes.

28. The method of claim 22, wherein the at least one ossicle attached to the magnet assembly includes both an incus and a stapes.

29. The method of claim 22, wherein the coil assembly is positioned such that a distal tip of the coil assembly is spaced a distance of about 1 millimeter to about 4 millimeters from the magnet assembly.

30. The method of claim 22, wherein the coil assembly further comprises a biocompatible casing adapted to house at least a portion of the core structure and at least a portion of the coiled wire structure.

31. The method of claim 22, wherein the core arm of the core structure has a length in a range of about 5.0 millimeters to about 14.0 millimeters.

32. The method of claim 22, wherein the core tail of the core structure has a length in a range of about 0.0 millimeters to about 2.0 millimeters.

33. The method of claim 22, wherein the outer diameter of the core arm of the core structure has a range of about 0.2 millimeters to about 0.8 millimeters.

34. The method of claim 22, wherein the outer diameter of the core tail of the core structure has a range of about 0.2 millimeters to about 1.2 millimeters.

35. The method of claim 22, wherein the coil portion of the coiled wire structure has a length in a range of about 6.0 millimeters to about 10.0 millimeters.

36. The method of claim 22, having a distance between the first end of the core arm and the coiled wire structure in a range of about 0.0 millimeters to about 2.0 millimeters.

37. The method of claim 22, wherein the sound processing device is implanted in a portion of a skull of the user.

38. The method of claim 22, wherein the sound processing device is implanted in a mastoid area of a temporal bone of a skull of the user near the ear.

39. The method of claim 22, wherein the sound processing device comprises a microphone for receiving sound waves, and a sound processor electrically connected to the microphone, wherein the microphone and sound processor cooperate to convert the sound waves received by the microphone into the electrical signal transmitted to the coil assembly.

40. The method of claim 39, wherein the sound processing device further comprises a radio frequency signal receiver for receiving a radio frequency signal for adjusting the electric signal transmitted to the coil assembly by the sound processor.

41. The method of claim 39, wherein the sound processing device further comprises a rechargeable battery.

42. The method of claim 39, wherein the sound processing device further comprises a biocompatible housing for containing the microphone and the sound processor.

* * * * *

UNITED STATES PATENT AND TRADEMARK OFFICE

CERTIFICATE OF CORRECTION

PATENT NO. : 7,651,460 B2
APPLICATION NO. : 11/084561
DATED : January 26, 2010
INVENTOR(S) : Rong Z. Gan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1287 days.

Signed and Sealed this

Twenty-eighth Day of December, 2010

David J. Kappos

David J. Kappos
*Director of the United States Patent and Trademark Office*